US008161769B2

(12) United States Patent
Lauchnor

(10) Patent No.: US 8,161,769 B2
(45) Date of Patent: Apr. 24, 2012

(54) REFRIGERATED CHEST FOR RAPIDLY QUENCHING BEVERAGES AND VISUALLY IDENTIFYING WHEN SUCH BEVERAGES REACH TARGET TEMPERATURE

(76) Inventor: John C. Lauchnor, West Simsbury, CT (US)

( * ) Notice: Subject to any disclaimer, the term of this patent is extended or adjusted under 35 U.S.C. 154(b) by 549 days.

(21) Appl. No.: 12/384,609

(22) Filed: Apr. 7, 2009

(65) Prior Publication Data

US 2010/0251755 A1 Oct. 7, 2010

(51) Int. Cl.
*F25D 3/08* (2006.01)
*F25D 17/02* (2006.01)
*F25D 25/00* (2006.01)

(52) U.S. Cl. ..... 62/457.7; 62/376; 62/378

(58) Field of Classification Search ..... 62/457.5, 62/457.7, 457.9, 64, 374, 376, 378
See application file for complete search history.

(56) References Cited

U.S. PATENT DOCUMENTS

| | | | | |
|---|---|---|---|---|
| 4,725,492 | A * | 2/1988 | Yazaki et al. | 428/317.7 |
| 4,920,763 | A * | 5/1990 | Provest et al. | 62/378 |
| 6,058,718 | A * | 5/2000 | Forsberg et al. | 62/125 |
| 7,165,415 | B2 * | 1/2007 | Nam et al. | 62/378 |
| 7,246,784 | B1 * | 7/2007 | Lopez | 248/588 |

FOREIGN PATENT DOCUMENTS

JP 2002168546 A * 6/2002

* cited by examiner

*Primary Examiner* — Chen Wen Jiang
(74) *Attorney, Agent, or Firm* — Day Pitney LLP

(57) ABSTRACT

The cooling chest for rapidly quenching beverages includes a quench tray for holding containers of beverage. The quench tray is lowered into salt-water or other cooling liquid which is cooled by a refrigeration unit. A processing device determines the temperature of the beverages within the containers within the quench tray and further activates a mechanism for removing the quench tray from the water or cooling liquid when the desired temperature is reached. The processing device can also activate the mechanism for removing the quench tray from the water or cooling liquid when the upper lid or access doors are opened.

14 Claims, 4 Drawing Sheets

REFRIGERATED CHEST FOR RAPIDLY QUENCHING BEVERAGES AND VISUALLY IDENTIFYING WHEN SUCH BEVERAGES REACH TARGET TEMPERATURE

BACKGROUND OF THE INVENTION

1. Field of the Invention

The present invention relates to a refrigerated chest for the quenching of beverages, particularly the rapid quenching of beverages to a pre-selected temperature and visual notification of when beverages are quenched to a certain temperature (i.e., ready to consume).

2. Description of the Prior Art

The use of traditional ice chests for cooling of beverages and maintaining the cooled temperature is well known in the prior art. However, the simple use of ice and water for these purposes has been problematic in that it can take thirty to sixty minutes to cool the beverages and the user has no way of visually determining when the drinks are cooled to the ideal temperature. In short, it has been difficult to determine if the beverages were sufficiently cooled or even over-cooled, and further difficult to maintain the optimum temperature for prolonged periods after the optimum temperature has been achieved.

Additionally, traditional ice chests have typically not provided the level of elegance and luxury sought by many of today's consumers. Particularly those who pride themselves with extravagant outdoor grills and patios.

OBJECTS AND SUMMARY OF THE INVENTION

It is therefore an object of the present invention to provide a chest for the rapid cooling or quenching of beverages to a pre-selected temperature through a combination of water quench and refrigeration (preferably within three to ten minutes), and for the indication that the pre-selected temperature of the drink has been achieved.

It is therefore a further object of the present invention to provide a chest for the rapid quenching of beverages to a pre-selected temperature through a combination of water quench and refrigeration and wherein the successful quenching of the beverages to a pre-selected temperature is indicated to the user.

It is therefore a further object of the invention to provide notification that beverages have reached the desired temperature.

It is therefore a still further object of the present invention to provide a chest for the rapid quenching of beverages wherein the pre-selected temperature is maintained for a period of time.

It is therefore a final object of the present invention to provide a level of elegance and luxury sought by many of today's consumers.

These and other objects are attained by providing a chest with an internal refrigeration unit for cooling water, typically brine (i.e., salt water, which can be cooled to less than 32° F. while remaining in the liquid state) or a similar liquid which partially fills the chest. The chest further includes an internal quench tray which lowers the beverage containers into the water or similar cooling liquid in order to quench the beverage containers, and which raises the beverages container from the water or similar cooling liquid whenever the lid of the chest is opened or whenever the beverages have been sufficiently quenched, and then cooled to the desired temperature.

The chest includes a control system for the user to select a desired temperature for the beverage. The control unit further monitors the temperature of the water or similar cooling liquid, and possibility the salinity of the water, and controls the refrigeration unit in order to sufficiently cool the quench tank. The control unit further activates lights built into the front wall of the chest to indicate that the beverages have been sufficiently quenched. In some embodiments, the control unit can provide for an "intelligent tray" wherein the tray includes a visual indicator, such as an LED, for each beverage container compartment within the quench tray to indicate the status of each beverage container within the compartment.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
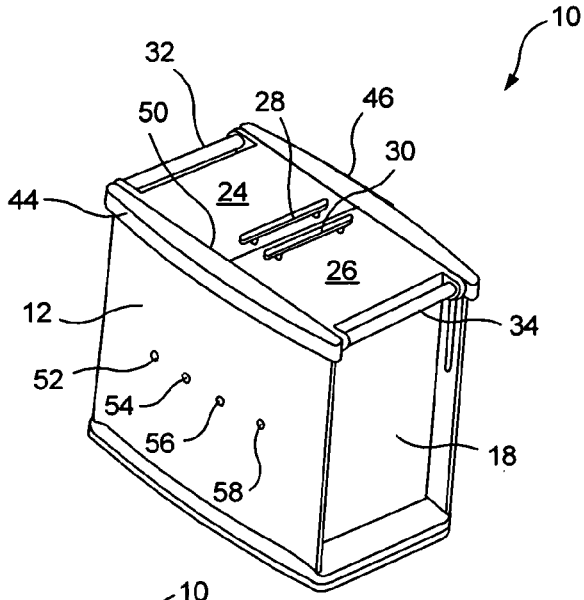
FIG. 1 is a perspective view of the cooling chest of an embodiment of the present invention, shown with the access doors or lids closed.
Figure 2:
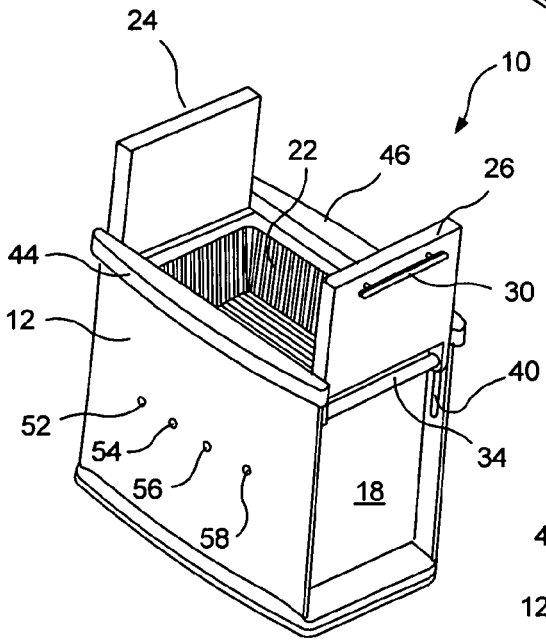
FIG. 2 is a perspective view of the cooling chest of an embodiment of the present invention, shown with the access doors or lids open, but not retracted.
Figure 3:
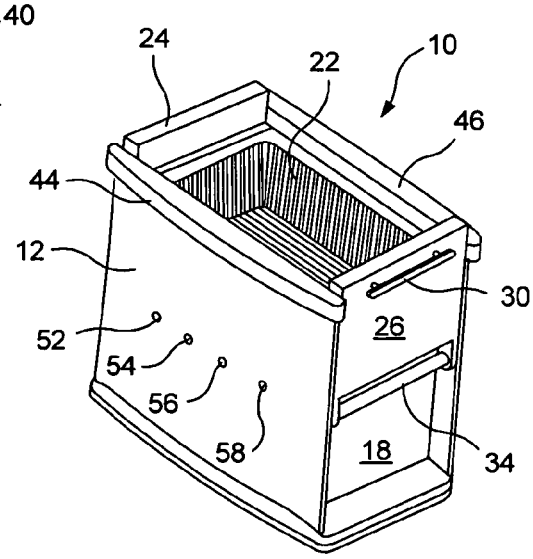
FIG. 3 is a perspective view of the cooling chest of an embodiment of the present invention, shown with the access door or lids open and retracted.
Figure 4:
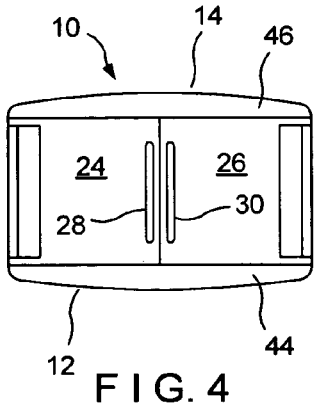
FIG. 4 is a top plan view of an embodiment of the present invention.
Figure 7:
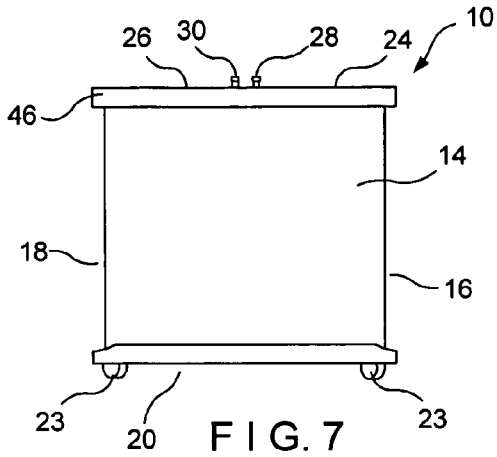
FIG. 7 is a back plan view of an embodiment of the present invention.
Figure 5:
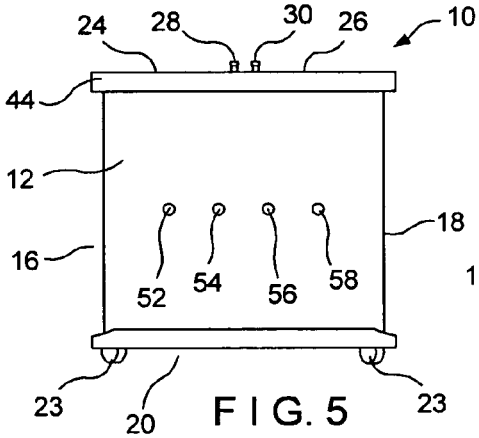
FIG. 5 is a front plan view of an embodiment of the present invention.
Figure 6:
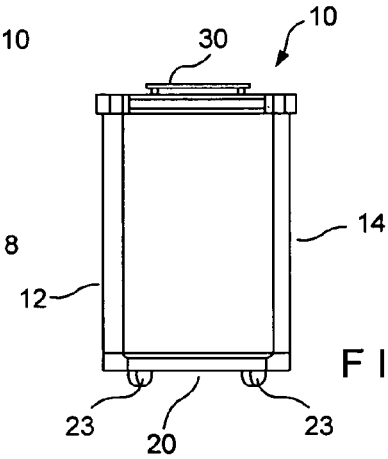
FIG. 6 is a side plan view of an embodiment of the present invention.

Referring now to the drawings in detail wherein like numerals indicate like elements throughout the several view, one sees from the various drawings that the chest 10 includes a front wall 12, a rear wall 14, side walls 16, 18 and a bottom wall 20, all in relatively fixed locations thereby forming an interior cooling volume 22. Bottom wall 20 includes wheels 23 at the four corners thereof. Additionally, the illustrated embodiment includes dual top lids or access doors 24, 26 which include respective access door handles 28, 30. Access doors 24, 26 can be in the closed position as shown in FIG. 1 to aid in maintaining the temperature within interior cooling volume 22. Access doors 24, 26 include pivot bars 32, 34 which are further engaged within inwardly facing linear tracks 40 formed in the interior of the lateral edges of the front and rear walls 12, 14, immediately outwardly adjacent of side walls 16, 18 (see FIGS. 2 and 9) thereby allowing the access doors 24, 26 to be initially pivoted open as shown in FIG. 2 and then moved linearly to the recessed position, immediately outwardly adjacent from the upper portions of side walls 16, 18, shown in FIG. 3. As shown in FIG. 1, pivot bars 32, 34 further form handles for the chest 10 when the access doors 24, 26 are in the closed position.

The walls 12-20 and access doors 24, 26 are typically formed of urethane filled stainless steel in order to provide a sleek, elegant appearance, while maintaining the desired temperature insulating capabilities. However, those skilled in the art will recognize a broad range of equivalents after review of this disclosure.

The upper edge of front and rear walls 12, 14 include respective front and rear enlarged bow-shaped gripping portions 44, 46 which allow the user to move or manipulate the chest 10, which can have a considerable weight when it contains the water or other cooling liquid.

A control panel 50, including data entry buttons, a display, and a control or processing unit, is built into a central portion of front enlarged bow-shaped gripping portion 44. This allows the user to enter the selected or desired temperature for the beverages. Additionally, front wall 14 includes circular LED windows 52, 54, 56, 58 which progressively light up as the temperature of the beverage approaches the desired temperature, with all LED windows 52, 54, 56, 58 lighting up when the desired temperature is reached. Ideally, the LED windows 52, 54, 56, 58 can be designed to flood the adjacent ground surface with a blue tint, or some other desired color. Red lights could be used to indicate that the desired cooling has not yet been achieved. Additionally, the control panel 50 could include a wi-fi or similar internet connection to allow for remote start-up of the chest 10.

Figure 8:
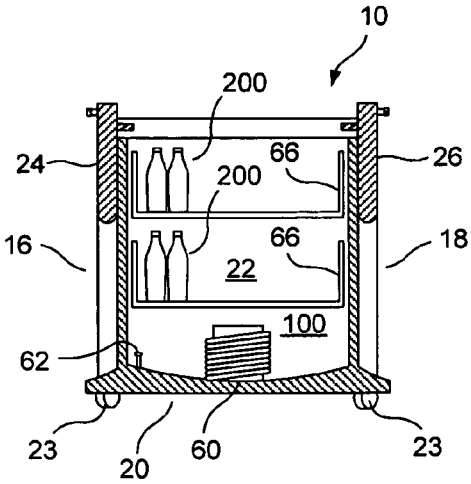
FIG. 8 is a cross-sectional view of an embodiment of the present invention, with the access doors or lids open and retracted, and showing the two positions of the quench tray.
Figure 9:
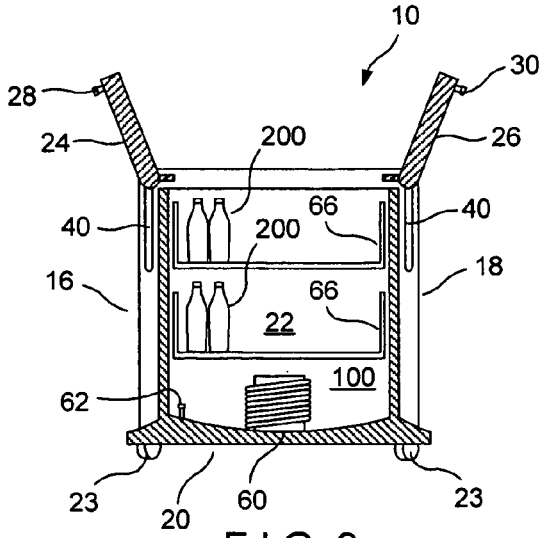
FIG. 9 is a cross-sectional view of an embodiment of the present invention, with the access doors or lids open but not retracted, and showing the two positions of the quench tray.

As shown in FIGS. 8 and 9, a refrigeration unit 60 and a sensor 62, for sensing temperature, and in some embodiments, salinity of the quench liquid, are built into the upper surface of bottom wall 20. Refrigeration unit 60 is typically powered by conventional AC voltage from a socket or similar source. Sensor 62 reads the temperature of the water (preferably salt-water, but preferably the chest 10 should be able to operate with or without salt inserted into the water) or other coolant 100 (and possibly the salinity) which partially fills the interior cooling volume 22 and provides the temperature information (and possibly salinity) to the processing unit of control panel 50, which controls the operation of the refrigeration unit 60. The refrigeration unit 60 is turned on when further cooling is desired and turned off when further cooling is not required.

As further shown in FIGS. 8 and 9, a quench tray 66 is provided within interior cooling volume 22. The quench tray 66 holds the beverage containers 200 and moves between an upper position which is removed from the water or other coolant 100 and a lower position which is within the water or other coolant 100 (both upper and lower positions of a single quench tray 66 are illustrated in both FIGS. 8 and 9). The quench tray 66 is lifted to its upper position (thereby removing quench tray 66 and the beverage containers 200 from the coolant 100) when access doors 24, 26 are opened (as sensed by a door sensor in communication with the processing unit of control panel 50) or when the quench tray 66 has immersed the beverage containers 200 within the coolant 100 for a predetermined period of time or other criteria as monitored by the logic of the processing unit of control panel 50. Alternatively, the processing unit of control panel 50 may determine when the temperature of the beverage within beverage containers 200 has reached the desired temperature, taking into account such information as the temperature history of water or other coolant 100 as well as the time that the beverage container 200 has been immersed within the water or other coolant 100. The processing unit of control panel 50 of this alternative embodiment typically includes an algorithm with equations or curves for calculating the rate of cooling of the beverage depending upon the history of the insertion of the beverage containers within the water or other coolant 100, as well as upon the history of the temperature of the water or other coolant 100. The cooling calculation could also take into account the initial temperature of the beverage as determined by user input, ambient temperature readings, or assumptions, as would be known to those skilled in the art after review of this disclosure.

Figure 11:
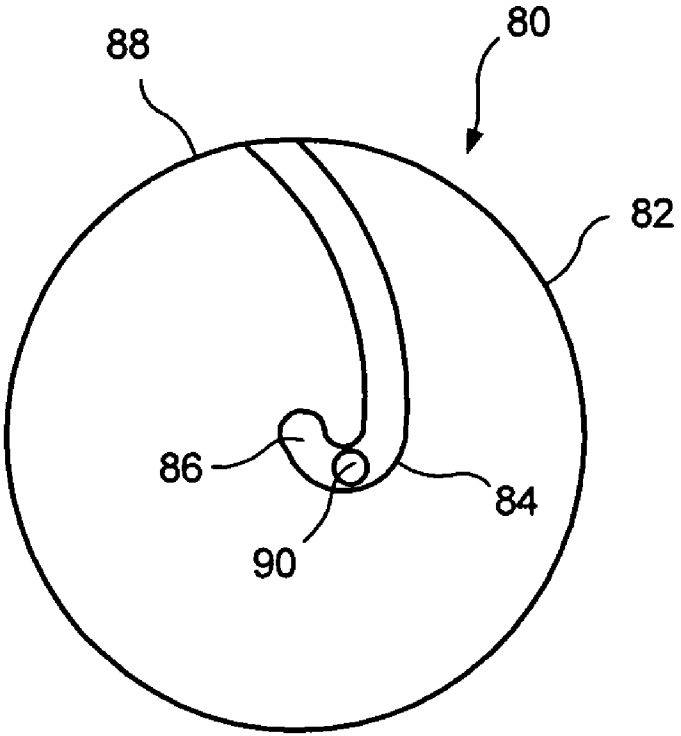
FIG. 11 is a plan view of a circular linear drive configured so that the quench tray is in the upper position (removed from the water or cooling liquid).
Figure 10:
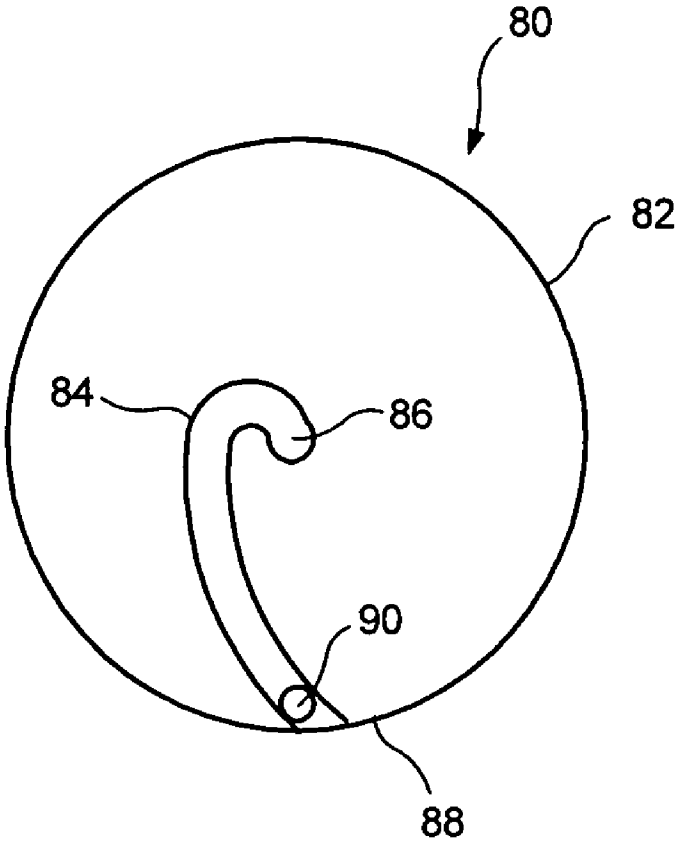
FIG. 10 is a plan view of a circular linear drive configured so that the quench tray is in the lower position (inserted into the water or cooling liquid).

The movement of the quench tray 66 between the upper and lower positions can be effected by a number of different mechanisms, such as a scissors-type mechanism (see FIG. 12), an inflatable bladder or ballast tank (see FIG. 13), a linear drive, or a linear circular drive 80 such as is illustrated in FIGS. 10 and 11. Linear circular drive 80 includes a circular disk 82 which is rotatably attached to an interior wall of the chest 10. Circular disk 82 includes a partially spiral groove 84 which extends from the center 86 (or near the center) of disk 82 to the edge 88 of disk 82. The partially spiral groove 84 is engaged by a boss 90 which is affixed to the quench tray 66 (which may be confined to vertical movement by linear tracks, not shown, which further facilitate the smooth movement of quench tray 66). In FIG. 10, the boss 90 is in a lower position, so the quench tray 66 would be in a lower position of FIGS. 8 and 9. In order to raise boss 90, and therefore raise the quench tray 66, disk 82 would be rotated counter-clockwise by a servo motor (not shown) or similar mechanism, in response to a command from the processing unit of control panel 50 (again, typically due to the calculation of the completion of the cooling cycle or the opening of access doors 24, 26) so that boss 90, along with quench tray 66, would be raised to the position shown in FIG. 11, corresponding to the upper position of quench tray 66 shown in FIGS. 8 and 9.

Figure 12:
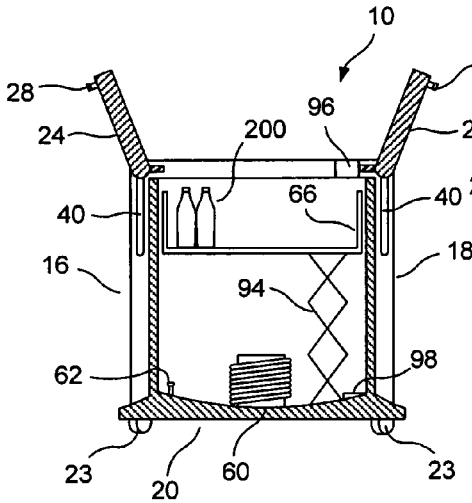
FIG. 12 is a plan, partially cut-away view, of an embodiment of the present invention using a scissors-type elevator mechanism to raise and lower the quench tray.
Figure 13:
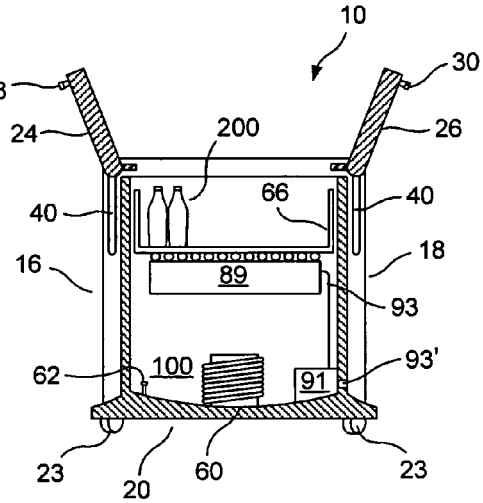
FIG. 13 is a plan, partially cut-away view of an embodiment of the present invention which uses a bladder or ballast-type container which can be selectively filled with air to assist in the raising of the quench tray.

Alternate methods of raising and lowering quench tray 66 are shown in FIGS. 12 and 13. In FIG. 12, a scissors-type elevator mechanism 94, responsive to driving mechanism 96 (such as a solenoid or similar electromechanical driving device) via rod 98 is provided. Driving mechanism 96 is typically placed above or away from the coolant 100. When the processing unit of control panel 50 determines that the quench tray 66 should be raised or lowered, the processing unit controls driving mechanism 96 to move rod 98 to raise the quench tray 66 by moving the hinged elements to a more vertical position or to lower the quench tray 66 by moving the hinged elements to a more horizontal position.

In FIG. 13, a ballast container (or flotation device) 89 is provided on the underside of quench tray 66. The ballast container 89 may be of a fixed volume and, similar to a submarine ballast tank, may be selectively filled with air to provide positive buoyancy and provide an upward force on quench tray 66 to remove at least the portion of the quench tray 66 containing the beverage containers 200 from the coolant 100 or may be selectively filled with water to provide virtually neutral buoyancy (i.e., no or minimal net force) to allow quench tray 66 to move downwardly and become immersed in coolant 100. The ballast container 89 may also be of a flexible bladder structure which can be inflated with air to provide positive buoyancy or from which the air can be pumped, to allow the bladder structure to deflate thereby providing virtually neutral buoyancy. In either case, an air pump 91 and associated tubing and valve(s) 93 as well as air inlet/outlet port 93', are provided which are responsive to the processing unit of control unit 50, to provide for air to be selectively provided to ballast container 89.

Figure 14:
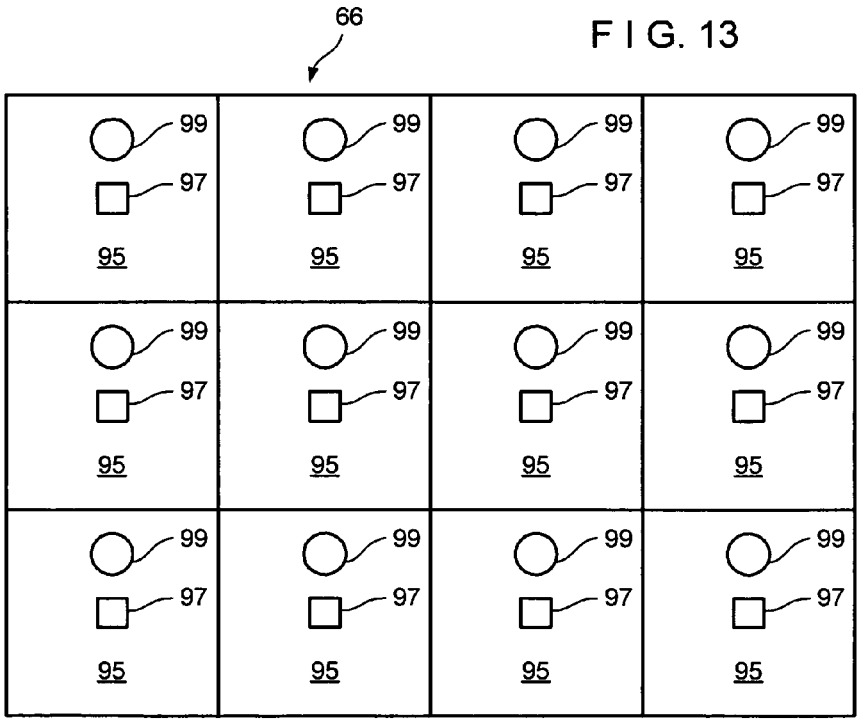
FIG. 14 is a top view of a quench tray of an embodiment of the present invention, an "intelligent tray" wherein visual indicators are provided for the various compartments of the quench tray to indicate the status of the beverage container contained in each compartment.

In FIG. 14, a quench tray 66 with intelligent features is provided. The quench tray 66 is provided with individual compartments 95 for the beverage containers 200 (not shown in FIG. 14). A container sensor 97 and an LED (or similar) indicator 99 are provided within each compartment 95. The container sensors 97 are in communication with the processing unit of control unit 50. Typically, the processing unit assumes that the beverage container 200 inserted into the compartment 95 is initially at room temperature. The processing unit can thereafter determine a quench history of the individual beverage containers 200 in each compartment 95 and can light the LED indicator 99 when the processing unit determines that the corresponding beverage container 200 has been adequately quenched.

In order to use chest 10, the user would typically fill the chest 10 with water or other coolant 100 to the appropriate level and place beverage containers into quench tray 66. The user would then close access doors 24, 26 and enter the appropriate data into control panel 50. The quench tray 66 could be lowered into the salt-water or other coolant 100 immediately. Alternatively, the quench tray 66 could be lowered into the salt-water or other coolant 100 only after the appropriate temperature of water or other coolant 100 has been reached. The quench tray 66 stays in the water or other coolant 100 for a predetermined quench period, or until either the processing unit of control panel 50 determines that the desired temperature of the beverage has been reached or until the access doors 24, 26 are opened. After the processing unit of control panel 50 determines that the desired temperature has been reached, LED windows 52, 54, 56, 58 would emit a blue light. This can be staggered so that more LED windows are successively illuminated as the calculated beverage temperature approaches the desired temperature.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A chest for quenching beverages including:

walls forming an interior cooling volume, for holding a cooling liquid;

a refrigeration unit for cooling the cooling liquid;

a quench tray for holding containers of beverage, which moves vertically between a first position and a second position, said first position being a relatively lower position and within the cooling liquid, and said second position being a relatively upper position and removed from the cooling liquid;

a mechanism for moving said quench tray between said first position and said second position, including a rotatable disk affixed to an interior of one of said walls, said rotatable disk including a spiral groove which engages a boss on said quenching tray, whereby rotational movement of said rotatable disk causes vertical movement of said quench tray;

a sensor for sensing a temperature of the cooling liquid; and a control device for receiving user input, receiving input for said sensor, for controlling said refrigeration unit, and for controlling movement of said quench tray between said first position and said second position.

2. A chest for quenching beverages including:

walls forming an interior cooling volume, for holding a cooling liquid;

a refrigeration unit for cooling the cooling liquid;

a quench tray for holding containers of beverage, which moves vertically between a first position and a second position, said first position being a relatively lower position and within the cooling liquid, and said second position being a relatively upper position and removed from the cooling liquid;

a mechanism for moving said quench tray between said first position and said second position, wherein said mechanism includes hinged elements which can be extended by moving the hinged elements to a more vertical position thereby raising said quench tray to said second position wherein said hinged elements are responsive to a rod operatively connected to the hinged elements, said rod being operatively connected to a driving mechanism;

a sensor for sensing a temperature of the cooling liquid; and a control device for receiving user input, receiving input for said sensor, for controlling said refrigeration unit, and for controlling movement of said quench tray between said first position and said second position, wherein said driving mechanism is responsive to said control device and wherein said driving mechanism is outside of the cooling liquid.

3. A chest for quenching beverages including:

walls forming an interior cooling volume, for holding a cooling liquid;

at least one door or lid on an upper surface thereof;

a refrigeration unit for cooling the cooling liquid;

a quench tray for holding containers of beverage, which moves between a first position and a second position, said first position being within the cooling liquid, and said second position being removed from the cooling liquid;

a sensor for sensing a temperature of the cooling liquid; and a control device for receiving user input, receiving input for said sensor, for controlling said refrigeration unit, and for controlling movement of said quench tray between said first position and said second position, wherein said quench tray is moved from said first position to said second position in response to said control unit determining that said at least one door or lid has been opened.

4. The chest for quenching beverages of claim 3 wherein at least a portion of said walls are formed of urethane filled stainless steel.

5. The chest for quenching beverages of claim 3 wherein an exterior of at least one of said walls includes at least one light, wherein said at least one light is illuminated in response to said control device when control device determines that the beverages have reached the desired temperature.

6. The chest for quenching beverages of claim 3 wherein said quench tray is moved from said first position to said second position in response to said control unit determining that the beverages have reached the desired temperature.

7. The chest for quenching beverages of claim 3 wherein said quench tray includes a flotation device which receives air to add to the buoyancy of the quench tray.

8. The chest for quenching beverages of claim 7 wherein said flotation device is a ballast container which is rigid.

9. The chest for quenching beverages of claim 7 wherein said flotation device is a ballast container of a fixed volume.

10. The chest for quenching beverages of claim 7 wherein said flotation device is flexible.

11. The chest for quenching beverages of claim 3 wherein said quench tray includes a plurality of compartments for receiving beverage containers and wherein each of said compartments include a container sensor communicating to said control device.

12. The chest for quenching beverages of claim 11 wherein each of said compartments includes an indicator, responsive to said control device, for indicating that the beverage container within the corresponding compartment has reached the desired temperature.

13. The chest for quenching beverages of claim 3, further including a mechanism for moving said quench tray between said first position and said second position, wherein said mechanism includes a rotary device, wherein rotation of the rotary device imparts a vertical force on the quench tray.

14. The chest for quenching beverages of claim 3, further including a mechanism for moving said quench tray between said first position and said second position, wherein said mechanism imparts a linearly upward vertical force on the quench tray.

* * * * *